US005472125A

United States Patent [19]

Barnard

[11] Patent Number: 5,472,125

[45] Date of Patent: Dec. 5, 1995

[54] METHOD AND APPARATUS FOR FORMING A NOTE PAD HOLDER

[76] Inventor: Steve Barnard, 1200 W. Elm, Fullerton, Calif. 92631

[21] Appl. No.: 162,667

[22] Filed: Dec. 6, 1993

[51] Int. Cl.[6] ..... A45F 5/00

[52] U.S. Cl. ..... 224/219; 224/267; 224/901

[58] Field of Search ..... 224/219–222, 224/267, 901

[56] References Cited

U.S. PATENT DOCUMENTS

| | | | |
|---|---|---|---|
| 753,457 | 3/1904 | Weissbrod | 224/219 |
| 956,534 | 5/1910 | Lahey | 224/219 |
| 1,438,145 | 12/1922 | Swartz | 224/220 |
| 1,701,888 | 2/1929 | Hofferberth | 224/219 X |
| 2,876,022 | 3/1959 | Kroviak | 224/222 |
| 4,722,627 | 2/1988 | Salacuse | 402/20 |
| 4,733,808 | 3/1988 | Turner, Jr. et al. | 224/219 |
| 4,824,140 | 4/1989 | Rankin | 281/8 |
| 5,009,347 | 4/1991 | Phelps | 224/219 |
| 5,060,794 | 8/1991 | Linn et al. | 206/232 |
| 5,127,545 | 7/1992 | French | 224/219 X |
| 5,183,153 | 2/1993 | Linn | 206/232 |
| 5,311,689 | 5/1994 | Lindsey | 224/267 X |

*Primary Examiner*—J. Casimer Jacyna
*Attorney, Agent, or Firm*—James D. Leimbach

[57] ABSTRACT

A wrist band note pad holder is constructed from flexible, inexpensive material to be worn on the wrist of a user. The note pad holder is attached to the wrist band and is designed to provide immediate access to note paper by a person driving an automobile to the contained note pad. "Placing and holding note paper within the note pad holder is provided for by allowing quick and easy access to note paper that is contained within an envelope used as part of the note pad holder that can open and close to secure note paper". Different embodiments teach usage of a securing band to help secure the wrist band note pad holder while in use. The wrist note pad can be constructed from numerous materials including nylon, denim, suede or leather. Various embodiments for holding a note pad are illustrated including a retainer between two pieces of the chosen material or a slot in the chosen material.

8 Claims, 3 Drawing Sheets

METHOD AND APPARATUS FOR FORMING A NOTE PAD HOLDER

BACKGROUND OF THE INVENTION

1. Field of the Invention

The invention relates to note pad holders, and more specifically, to note pad holders which are formed on a wrist strap of a user.

2. Description of the Prior Art

Numerous teachings have been made of devices for creating note pads for holding paper in a desired fashion. Mankind has continually been obsessed with means for recording and reminding himself of the numerous occurrences of things in his life and for recording items on his agenda. A few of these items considered pertinent to the disclosure of the present invention are discussed, hereinbelow.

U.S. Pat. No. 5,060,794 issued to Linn et al. on Oct. 29, 1991 for a REMINDER SYSTEM (hereinafter referred to as "Linn et al") disclosed a Key Ring and Memo Pad which taught a note pad holder attached to a key ring. The invention disclosed by "Linn et al." taught a device that provided a memo pad having means for holding a writing instrument. The device disclosed by "Linn et al." was only accessible to a user when the key chain was not in use. The teachings of "Linn et al." made no provisions for a note pad device capable of being used when a key on the key chain was being used, for example when the user was driving.

U.S. Pat. No. 5,183,153 issued to Linn on Feb. 2, 1993 for a PAD HOLDER (hereinafter referred to as "Linn") also disclosed a Key Ring and Memo Pad. The invention disclosed by "Linn", like that of "Linn et al", taught a note pad device accessible only when the user was not using one of the keys on the key chain. Here again, no provisions were made for accessing the note pad when the user was driving.

U.S. Pat. No. 4,824,140 issued to Rankin on Apr. 25, 1989 for a WRIST NOTE PAD (hereinafter referred to as "Rankin") taught a wrist note pad having a housing pivotally connected to a wrist band. Internal to the housing was a paper roll journeled to the housing at either end. A rewind knob and a paper feed knob are both positioned on the housing to operate the paper roll. The teachings of "Rankin" while creating a device that is accessible to users while driving an automobile taught a device containing numerous moving parts, thus, making the device complicated and expensive to manufacture.

It should be apparent from the foregoing discussion, there remains a need within art of note pad holders for a method and apparatus allowing access to a note pad when the user is driving that requires few, if any, moving parts and that is inexpensive to manufacture. It is these problems within the prior art that the present invention addresses.

SUMMARY OF THE INVENTION

The present invention discloses an apparatus for holding a note pad in juxtaposition on the wrist of a user enabling the user to access the note pad at virtually any time, especially when driving. A wrist band is attached to note pad holding means that can readily be made from inexpensive materials. The wrist note pad is made from nylon, denim, suede or leather and can be attached to the wrist by hook and loop fasteners or buckles. Note pad holding means can be created having either a slot on the surface of the of the holding means, or a compartment formed therein, for retaining a note pad.

It is the object of the invention to create a simple and inexpensive note pad holder that can be attached to the wrist of the user and used at virtually any time.

It is further the object of the invention to teach a wrist note pad that can use readily available sources as stock for paper for the note pad holder.

It is still further the object of the invention to create a note pad holder that can be used by persons owing cellular telephones while driving their automobiles.

DETAILED DESCRIPTION OF THE PREFERRED EMBODIMENT

Figure 1A:
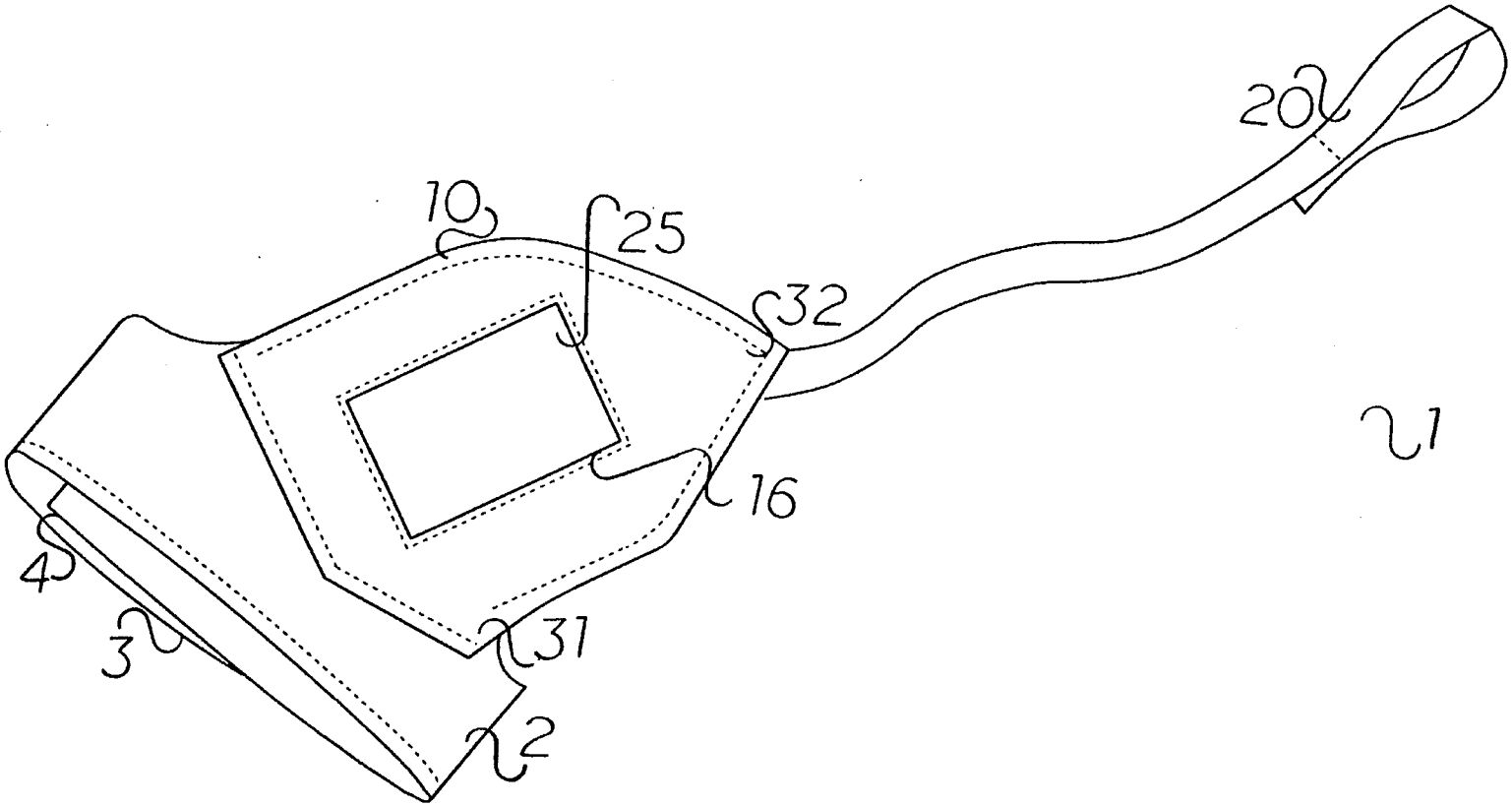
FIG. 1*a* is a perspective view of the first preferred embodiment of the invention in an closed position.
Figure 1B:
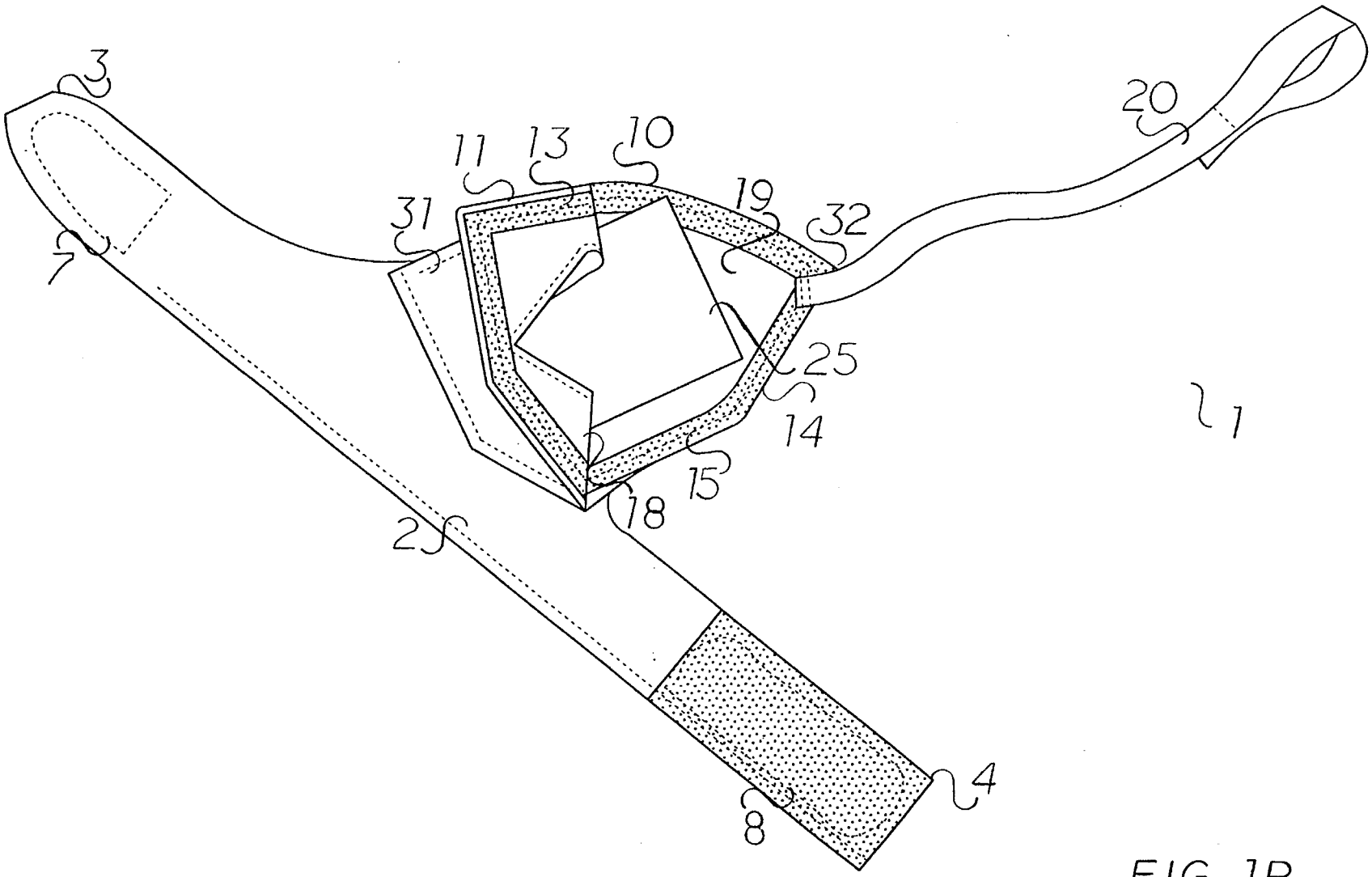
FIG. 1*b* is a perspective view of the first preferred embodiment of the invention in an open position.

It has been discovered that an apparatus for a wrist band contained note pad holder can be inexpensively constructed from readily available materials. Referring to FIG. 1, the first preferred embodiment of the invention can be seen as a wrist band note pad holder, generally designated by reference numeral 1, is formed by employing wrist band 2 having a first end 3 with first velcro patch 7 and second end 4 with second hook and loop fastener 8 attached, thereto. Note pad holding means 10 are attached to wrist band. The note pad holding means is designed to provide immediate access by a person driving an automobile to the contained note pad. a securing band 20 helps to secure the wrist band note pad holder while in use.

In the first preferred embodiment, the wrist band 2 is constructed substantially of nylon pieces that are stitched together. The principal reason for the use of nylon as a material is that nylon can easily be stitched to form various articles which are strong and durable and because nylon is inexpensive. Embodiments using nylon as the basic material preferably employ attachment means made from hook and loop fasteners 7, 8 stitched to each first end 3 and seconds end 4 of wrist band 2. The wrist band 2 can then be attached to the wrist of a user by wrapping first and second ends 3, 4 of wrist band 2 around the wrist of the user and securing wrist band 2 by hook and loop fasteners 7, 8.

Note pad holding means 10 are formed on wrist band 2 having a first end 31 of note pad holding means 10 attached to wrist band 2, and a second end 32 of note pad holding means 10 having a securing cord 20 being attached, therefore, which can be fastened to the thumb or finger of a user. Note pad holding means 10 is attached to the wrist band 2 by employing stitched nylon pieces as the basic building material to construct note pad holding means 10 and attaching note pad holding means 10 to wrist band 2, again, by stitching.

Preferably, the note pad holding means 10 are constructed from first nylon piece 11 which can be constructed from nylon in any of many varying degrees of thickness, or, furthermore, any of several materials. First nylon piece 11 is attached to wrist band 2 between first and second ends 3, 4. Second nylon piece 14 of note pad holding means 10 can be formed as a portion of wrist band 2 thereby leaving only first nylon piece 11 to being stitched to wrist band 2. Alternatively, second nylon piece 14 can be manufactured in a fashion similar to that of first nylon piece 11 and both can be sewn to wrist band 2 or, if so desired both first and second nylon pieces can be individually attached to wrist band 2.

First and second nylon pieces 11, 14 have first and second hook and loop fastening rims 13, 15, respectively, stitched to interiors 18, 19 of nylon pieces 11, 14. Velcro rims 13, 15 are positioned on the interior portions 18, 19 of first and second nylon pieces 11, 14 to enable cooperation between hook and loop fastening rims 13, 15. The result is a retainer 16 formed that is essentially an envelope between nylon pieces 11, 14 which will contain note pad paper 25 that can easily be opened and closed by either separating or pressing together hook and loop fastening rims 13, 15. This configuration allows simple manual insertion of inexpensive post it paper, and removal of the same if so desired.

A window aperture 12 is formed in first nylon piece 11 to allow a writing utensil to engage the note pad paper 25 contained in retainer 16. It is essential that window 12 be formed in a geometric shape that will hold note paper 25 within retainer 16 while allowing a writing utensil the opportunity to enter window 12 to take notes upon note paper 25. In this manner, note paper 25 is held in place by retainer 16 upon the wrist of the user allowing the user to take notes upon his wrist by inserting a writing utensil within window 12 to write upon note paper 25.

A securing cord 20 is providently attached to the note pad holding means 10 at second end 32 to further secure the entire wrist note pad while in use. Loop 21 is formed on securing cord 20 to help secure the entire wrist note pad 1 by providing the additional fastening point on a finger or thumb of a user and assist in attaching wrist not pad 1 to the wrist of the user while in use. Securing cord 20 is used in this particular embodiment due to the note pad holding means 10 being formed upon wrist band 2 in a not centered manner. However, embodiments are equally envisioned wherein the note pad holder would be centered on the wrist band and not necessarily require a securing cord, as discussed hereinbelow.

Figure 2:
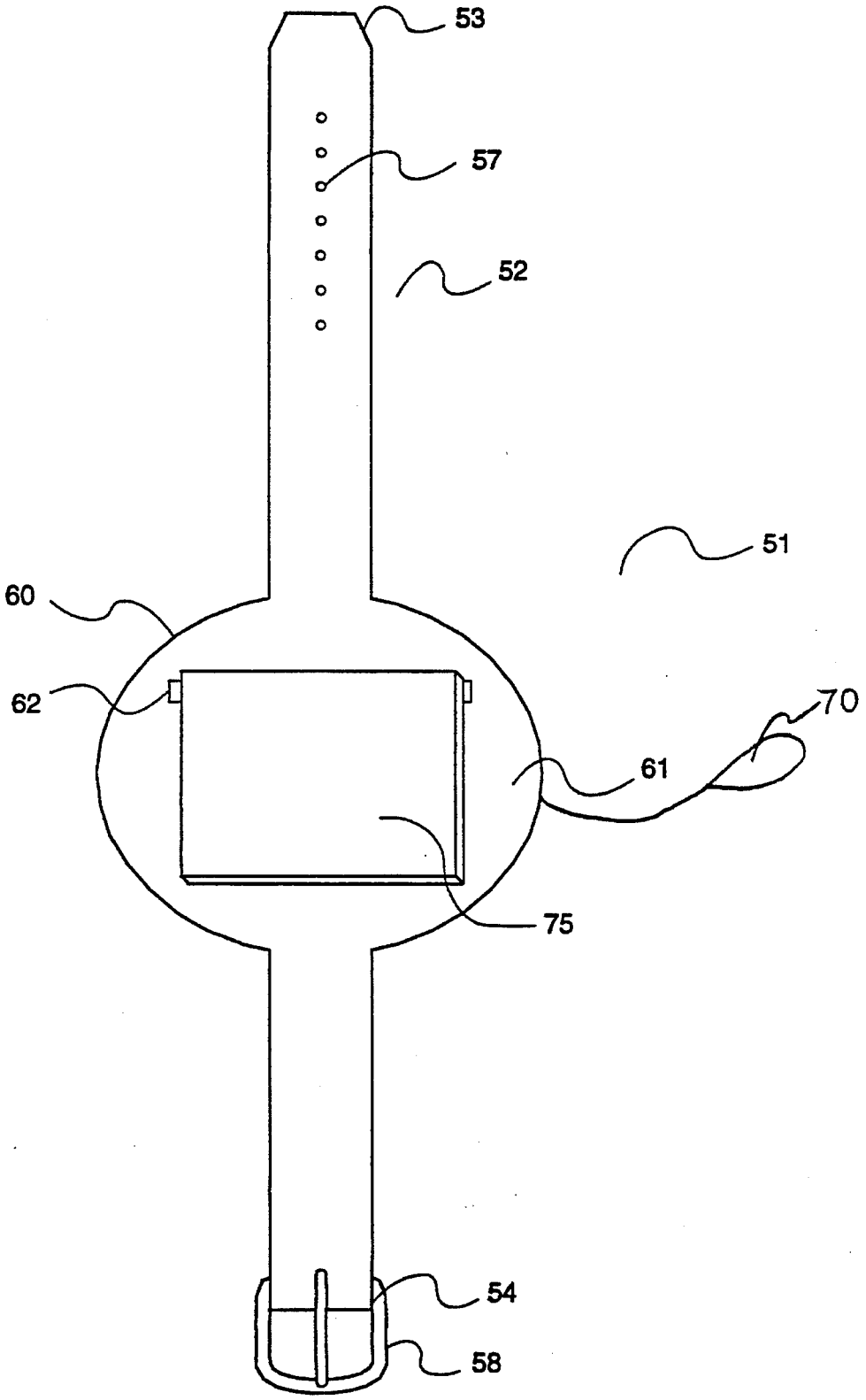
FIG. 2 is the perspective view of the second preferred embodiment of the invention.

Referring now to FIG. 2 a second preferred embodiment of the invention can be seen. Here wrist note pad generally referred to as 51 is constructed from leather material. Leather provides a sporting look and is an extremely durable material. The wrist note pad as seen in FIG. 2 comprises leather wrist band 52 having first and second ends 53, and 54. Buckle attachments 57, 58 are formed on first and second end 53, and 54, respectively by forming a series of holes 57 near the first end 53 of band 52 and employing a buckle arrangement 58 on second end 54.

Note pad holder 60 is attached to band 52 and, preferably, also formed from leather. In the second preferred embodiment note pad holder is stitched to leather wrist band 52. Note pad holder 60 comprises leather pad 61 with retention slot 62. The embodiment shown in FIG. 2 differs from the embodiment shown in FIG. 1 and discussed above not only in the material used but also in the manner of basic design. Here, retention slot 62 is significantly different means of retaining post it pad 75. In the second embodiment pad 75 is inserted into retention slot 62 and the pages of the pad 75 can be removed or flipped as desired by the user. The second embodiment, as shown in FIG. 2, is one that employs a note pad holder 60 centered upon wrist band 52 and made from leather. Therefore, this is one such embodiment in which a securing strap is not quite as necessary as the above discussed first embodiment. However, it is envisioned that further securing may be desirable, therefore, leather strap 70 can used to further secure wrist note pad 51 to the wrist of a user is attached to note pad holder 60 at one end and having leather loop 71 attached to the thumb or finger of the user at the other end. Furthermore, leather loop 71 provides an amount of esthetic appeal, that may be desirable for many users.

It should be understood that numerous other means could be used to attach note pad holder 60 to band 52, such as studs or epoxy. Additionally, note pad holder 60 can be formed as an integral part of band 52 in a single piece. This configuration would have the advantages of ease and cost of manufacturing.

Referring now to FIG. 1 in conjunction with FIG. 2, It should be understood that the retention slot 62 as disclosed in the leather embodiment of FIG. 2 could also be employed in a nylon embodiment. Likewise, a retainer 16 as disclosed in the nylon embodiment could also be made by employing leather as a material. Using leather as a material would for a retainer 16 would not require first hook and loop fastening rim 13 and second hook and loop fastening rim 15 but simply that two pieces of leather be stitched together to form note pad retainer 16. The resilient nature of leather would hold the note paper 25 within retainer 16.

In a similar manner certain elements of the first and second embodiments could be selectively chosen and combined to create additional embodiments. As a further example (not shown in the figures) a hook and loop fastening strap could be used as an attachment mechanism at one for the wrist band with a buckle at the other end of the wrist strap. Attachment to a human wrist is secured by wrapping the hook and loop fastening strap around the buckle and reattaching the strap to itself.

In a similar fashion numerous other materials, such as terry cloth with enclosed elastic, could be used as a wrist band and numerous other configurations of a note pad holder are possible from various materials. Among these material are suede or denim materials which have desirable features of affordability in obtaining the raw material combined with ease in manufacture and esthetic appeal. Additionally, attached means for the various wrist bands can include elastic or other stretchable materials.

The embodiments of the present invention illustrated herein may all be created with inexpensive materials. This being due to the advantage that the present invention has in manufacturing.

The invention may also be used with the wrist note pad holder having writing utensil attachment means (not shown) for attaching a writing utensil to the wrist note pad holder. This is a simple and obvious variation of the present invention.

While, the foregoing Description of the Preferred Embodiment details the best modes known by the inventors of practicing the invention, various modifications will be obvious to those skilled in the relevant arts. Therefore it is intended that the scope of the present invention be measured by the appended claims.

What is claimed is:

1. A wrist note pad holder comprising:

a wrist band extending from a first end to a second end;

attachment means contained on said wrist band for securing said first and second ends of said wrist band to human wrists; and a note pad holder attached to said wrist band, said note pad holder further comprising:

a top piece and a bottom piece, said bottom piece and said top piece being made from a flexible material, said bottom piece being attached to said top piece by stitching said top piece and said bottom piece together along at least one edge, said bottom piece being attached to said wrist band also on at least one edge;

fastening means for removably securing edges of said top and bottom pieces that are not stitched to one another or to the wrist band;

an envelope formed between said top and bottom pieces allowing for manual insertion and removal of note paper, said envelope serving to retain note paper while said fastening means are engaged; and window means formed within said top piece for allowing a writing utensil to enter said envelope, said window means being formed of a size smaller than said envelope.

2. The invention of claim 1 further comprising securing means for providing additional stability of said wrist note pad holder to a user, said securing means being attached to both said wrist note pad holder and to a user.

3. The invention defined by claim 1 wherein said wrist band is constructed from a material selected from the group of either: nylon, leather, or cloth.

4. The invention defined by claim 1 wherein said attachment means is comprised from any one of the following: hook and loop fasteners; buckles; or elastic.

5. The invention defined by claim 1 wherein said attachment means comprises a pair of hook and loop fasteners contained at said first end and said second end of said wrist band.

6. The invention defined by claim 1 wherein said attachment means comprises a pair of hook and loop fastening strips contained at said first end and said second end of said wrist band.

7. A note pad holder for wearing on a wrist comprising:

a wrist band extending from a first end to a second end;

attachment means contained on said wrist band for securing said wrist band to human wrists;

a note pad holder attached to and forming part of said wrist band; said note pad holder further comprising:

an envelope formed between a top piece and a bottom piece allowing for manual insertion and removal of note paper said bottom piece being attached to said wrist band on at least one edge; and fastening means for opening and closing said envelope and for securing note paper inside said envelope such that enclosed note paper is secured within the envelope, said fastening means having cooperating hook and loop fasteners that allow for said envelope to enclose note paper inside said envelope; and window means formed within said top piece for allowing a writing utensil to enter said envelope, said window means being formed of a size smaller than said envelope.

8. The invention defined by claim 7 further comprising:

said wrist band being a nylon band, said nylon band having a first and a second hook and loop fastener attached at said first and second end to form said attachment means; and a nylon pad forming said note pad holder, said nylon pad being constructed from a plurality of nylon pieces forming said top and bottom pieces of said envelope, said envelope having a hook and loop fastening rim on both interior sides of said top and said bottom which cooperate to seal said note pad holder.

* * * * *